US007102590B2

(12) United States Patent
Regala

(10) Patent No.: US 7,102,590 B2
(45) Date of Patent: Sep. 5, 2006

(54) PORTABLE TELESCOPING LINE-OF-SIGHT ARRAY ANTENNA

(75) Inventor: Florenio Pinili Regala, Costa Mesa, CA (US)

(73) Assignee: FPR Enterprises, LLC, Costa Mesa, CA (US)

( * ) Notice: Subject to any disclaimer, the term of this patent is extended or adjusted under 35 U.S.C. 154(b) by 0 days.

(21) Appl. No.: 10/941,141

(22) Filed: Sep. 14, 2004

(65) Prior Publication Data

US 2006/0055623 A1 Mar. 16, 2006

(51) Int. Cl.
*H01Q 1/10* (2006.01)
*H01Q 4/00* (2006.01)

(52) U.S. Cl. ..... 343/901; 343/844

(58) Field of Classification Search ..... 343/702, 343/853, 725, 727, 893, 901, 844
See application file for complete search history.

(56) References Cited

U.S. PATENT DOCUMENTS 4,730,797 A * 3/1988 Minovitch ..... 244/158.3
5,966,099 A * 10/1999 Xue ..... 343/702
6,147,653 A * 11/2000 Wallace et al. ..... 343/702
6,147,658 A * 11/2000 Higashi et al. ..... 343/853
6,844,854 B1 * 1/2005 Johnson et al. ..... 343/702

* cited by examiner

*Primary Examiner*—Hoanganh Le
*Assistant Examiner*—Minh Dieu A
(74) *Attorney, Agent, or Firm*—Jon A. Gibbons; Scott D. Smiley; Fleit, Kain, Gibbons, Gutman, Bongini & Bianco P.L.

(57) ABSTRACT

An antenna (100) includes an array of telescoping elements (402*a–d*) connected to and by a conductive disk (404) that feeds a signal to the elements (402*a–d*) from a matching circuit (506) within a body section (412). Each element (402*a–d*) has a joint (602, 604) making it individually angularly bendable. The body section (412) is attached to a swivel assembly (414) for adjusting the angle of the array (402*a–d*). A coaxial cable runs from the matching circuit (506), through the swivel assembly (412) and to a connector (502) within a connector assembly (422) for attachment to a radio.

18 Claims, 6 Drawing Sheets

PORTABLE TELESCOPING LINE-OF-SIGHT ARRAY ANTENNA

BACKGROUND OF THE INVENTION

1. Field of the Invention

This invention relates in general to antennas and more particularly, to portable line-of-sight array antennas.

2. Description of the Related Art

The ability to reliably communicate from one location to another is important in many situations, but few have the potential to be as important than those communications that occur between military personnel in the field of battle. Soldiers must be able to wirelessly communicate reliably and efficiently with others.

Wireless communication is accomplished through use of a radio connected to a radiating element, or antenna. An antenna is an impedance-matching device used to absorb or radiate electromagnetic waves into the environment. The function of the antenna is to "match" the impedance of the propagating medium, which is usually air or free space, to the source of the radio waves, i.e., output of the radio.

Antennas are available in many different shapes and sizes. The particular shape and size of an antenna designed for a particular application depends on many factors, such as the frequency or range of frequencies being received and transmitted, the expected environment the antenna will endure, size limitations, power efficiency limitations, application particulars, and many more.

Communication between two stations on the ground is most easily accomplished with radiating elements commonly called "monopoles" or "dipoles." A dipole has two elements of equal size arranged in a shared axial alignment configuration with a small gap between the two elements. Each element of the dipole is fed with a charge 180 degrees out of phase from the other. In this manner, the elements will have opposite charges and common nulls, or points of no charge. A monopole, in contrast, has only one element, but operates in conjunction with a ground plane, which mimics the missing second element.

One of the characteristics of antenna transmission is "polarization," which describes the physical plane the signal is transmitted. A dipole or monopole oriented in a vertical position, with reference to the horizontal orientation of the earth's surface, radiates signals in a straight line with a vertical polarization, know as line-of-sight ("LOS"). For a second antenna to receive maximum signal strength, it too must have a vertical orientation. As the receiving antenna is rotated away from vertical, its maximum receive power diminishes until the antenna reaches a horizontal orientation (perpendicular to the transmit antenna), at which time the maximum receive power reaches zero. It is therefore necessary to be able to orient a first antenna to match the orientation of a second antenna to maximize transmission and reception power, or "gain" between the antennas.

"Man-Pack" radios are mobile radios designed to be carried or worn on a person and are commonly used by Military or Paramilitary soldiers in the field on the move or at halt. A configuration of an antenna often found in Man Pack radios is a helical antenna, called a "helix". In its simplest form, a helix is a conducting wire wound in the form of a screw thread and propagates radio frequency (RF) waves with a vertical polarization.

Helix antennas are attractive for Man Pack portable radio applications because of the antenna's relatively small size. The helix antenna axial length is shorter than the traditional resonant monopole, which is typically ¼ of a wavelength ($\lambda$) or a dipole antenna, which is typically ½$\lambda$. A normal-mode helix antenna length is very short ($nL \ll \lambda$), typically only 0.1 $\lambda$.

The helix antenna, although useful, has several shortcomings. One shortcoming is a helix antenna is fixed in length and width dimensions and has an appreciable weight. To be portable, the helix antenna must be disassembled when carried and reassembled when deployed, which takes several minutes for each process. In combat situations, each minute is critical to avoid loss of lives. Another shortcoming is the helix antenna has a series loss resistance of the long spiral conductor is substantial, thereby consuming power. In portable mobile applications power is limited to what can be easily carried in the field.

Alternative to a helix antenna is a lightweight, compactable, telescoping antenna that is similar in construction to a telescoping antenna found on automobiles or cellular phones. Telescoping antenna systems, although useful, are not without their shortcomings. Once shortcoming is a telescoping antenna works efficiently only over a narrow band of frequencies. Effective communication in the field requires systems that function over a broad range of frequencies. The advent of multi-octave Man Pack broadband hand-held radios requires a broadband antenna. Therefore, the standard telescoping antenna is incompatible with the new generations of broadband radios.

Accordingly, a need exists to overcome the shortcomings with the prior art and to provide a portable, lightweight, efficient, high gain, broadband, line-of-sight antenna communication system that can easily be deployed in the field.

SUMMARY OF THE INVENTION

Briefly, in accordance with the present invention, disclosed is a telescoping monopole array antenna assembly that is attachable to a portable radio and wearable on a person, a vehicle, or any platform. The assembly includes a body that houses electrical circuitry. The body supports and provides electrical signals from the circuitry to a circular conductive mounting disk. The circular conductive mounting disk includes a plurality of telescoping electromagnetic wave-propagating elements. The plurality of elements electrically resemble a single element that is much thicker than each individual element in the array. The resulting array of elements provides an antenna that is efficient over a much larger bandwidth than each of the individual elements in the array.

In one embodiment, the two or more elements are arranged in a circular array and concentric with a conductive circular mounting disk attached to the body. The disc connects all the telescoping antenna radiating elements and serves as the antenna feed point or excitation terminal. The top ends of the antennas are open and not connected together.

In another embodiment, each element is attached to the body with a pivoting joint, and/or bendable section along the length of the element. This permits the angle of the individual elements to be adjusted. For example, the telescoping radiators can be arranged in a vertical position or in a conical arrangement with the vertex or apex at the mounting disc. This adjustment provides tunability for optimum gain and bandwidth. Due to the telescoping feature, the elements are also adjustable in a lengthwise direction, providing further tunability.

In yet another embodiment, attached to the mounting disk is the antenna body section which houses antenna matching circuitry. This antenna impedance-compensating network is determined by using the radio (chassis or frame) as the antenna ground plane. In one embodiment, the circuitry also includes a signal amplifying circuit to improve reception and transmission performance.

In still another embodiment, attached to the antenna housing is an antenna swivel. The swivel can be a ball-type or gooseneck type swivel that allows the operator to change the antenna assembly position relative to the man pack radio.

Finally, a radio-antenna interface connector provides an electrical communication pathway from the antenna assembly to the radio, which provides the signals transmitted by the antenna assembly and receives the signals received by the antenna assembly.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention, in which.

DETAILED DESCRIPTION OF THE PREFERRED EMBODIMENTS

Figure 1:
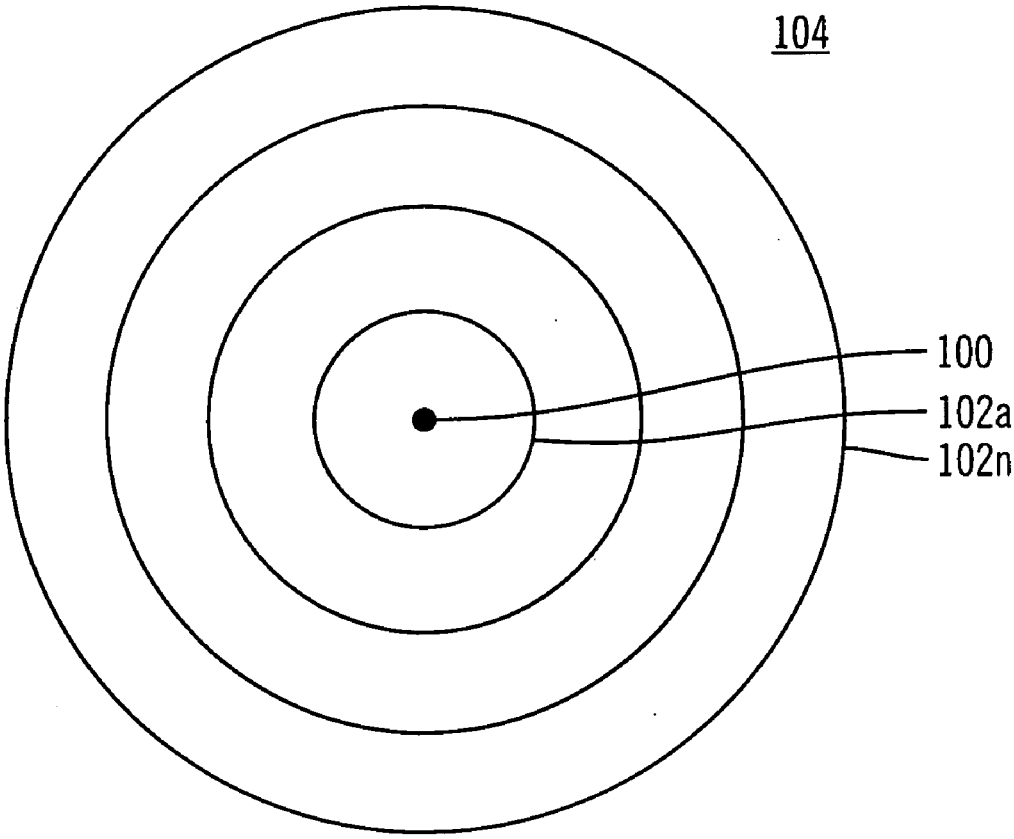
FIG. 1 is an elevational-view illustrating a radiation pattern of the inventive antenna.

While the specification concludes with claims defining the features of the invention that are regarded as novel, it is believed that the invention will be better understood from a consideration of the following description in conjunction with the drawing figures, in which like reference numerals are carried forward.

The present invention, according to an embodiment, overcomes problems with the prior art by providing an antenna that is small in size and weight and can be easily and quickly deployed. The invention can be worn on a person, a vehicle, or any platform. The inventive antenna provides a relatively wide bandwidth and is efficient in transmission, reception, and power dissipation. Each element of the antenna is easily adjustable in both length and angle, providing a large amount of tunability. Additionally, the entire antenna is easily adjustable to a wide range of angles.

Described now is an exemplary antenna configuration for an omnidirectional, vertically polarized, line-of-sight (LOS), array antenna, according to an exemplary embodiment of the present invention. With reference to FIG. 1 an omnidirectional radiation pattern 102*a–n* of the inventive antenna 100 is shown. FIG. 1 illustrates the antenna 100 emanating radio waves 102*a–n*, which are known by those of skill in the art to be a combination of electric and magnetic fields, with the energy divided equally between the two, and referred to as "electromagnetic radiation." FIG. 1 is an elevational view directly above (or below) the antenna 100. For clarity, in FIG. 1, the antenna 100 is represented by a single point 100.

In the reference angle shown in FIG. 1, using the antenna 100 as the axis, it can be seen that antenna 100 produces a radiation pattern that is substantially uniform throughout all angles and can communicate equally well in all directions. Importantly, the antenna 100 receives electromagnetic waves as efficiently as it transmits. Therefore, the electromagnetic waves 102*a–n* can also represent waves being received by the antenna 100.

From the view of FIG. 1, it can be seen that the waves form a spherical surface with a circumference that increases exponentially as the distance from the antenna increases. From the viewpoint of an observer a relatively short distance from the antenna, the wavefront approaches the appearance of a flat wall. A wave that is far enough from the source to appear flat is called a "plane wave."

Figure 2:
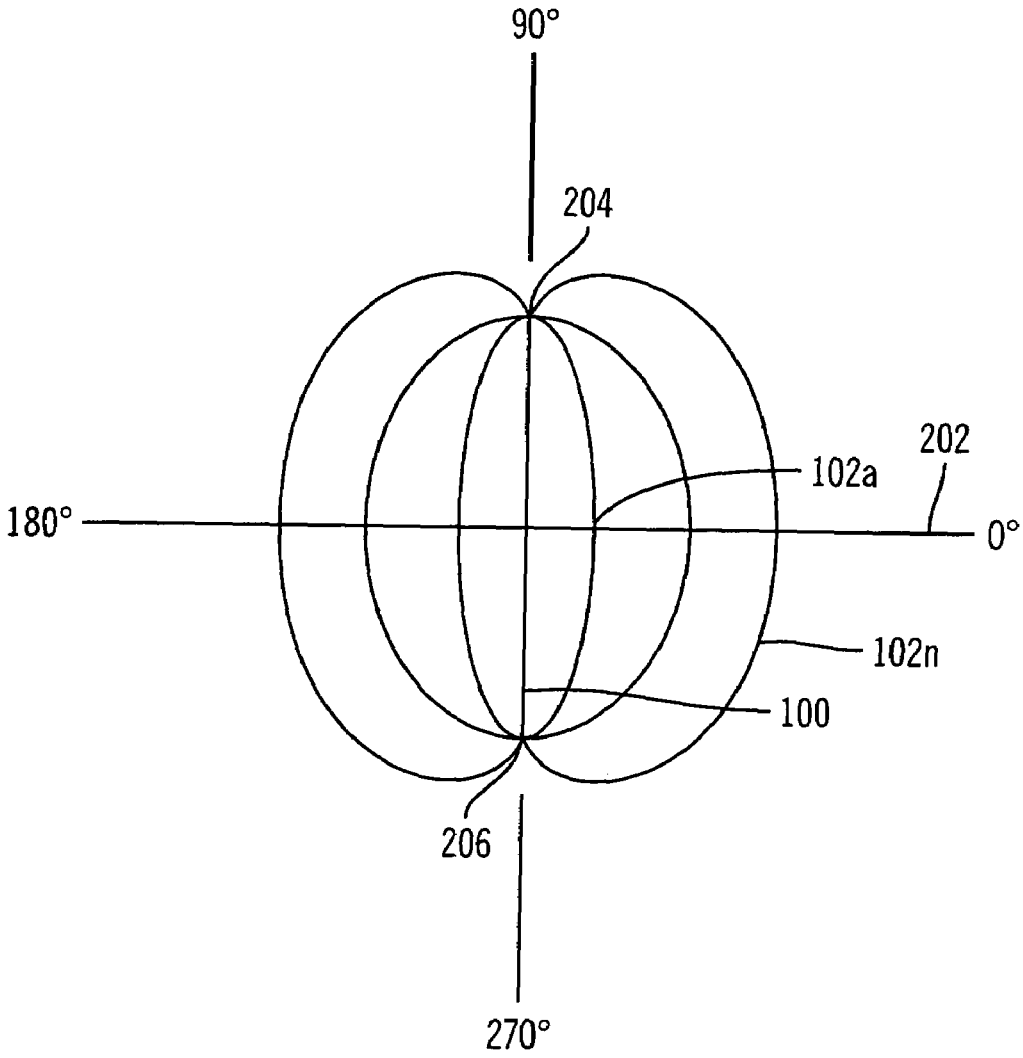
FIG. 2 is a side-view of FIG. 1, illustrating the radiation pattern of the inventive antenna.

FIG. 2 is a side-view of the same electromagnetic radiation pattern 102*a–n* shown in FIG. 1, viewed from the perspective of the horizon 202 crossing the antenna 100 at some point along its length. Antenna 100 is vertically oriented, meaning that a first end 204 of the antenna 100 is oriented in a direction toward 90 degrees in relation to the horizon, and a second end 206 of the antenna 100 is oriented in a direction toward 270 degrees in relation to the horizon.

The view shown in FIG. 2 shows a radiation pattern that differs greatly from that shown in FIG. 1. FIG. 2 shows that radiation strength, also called "gain," decreases from a maximum value at approximately 0 degrees and 180 degrees to approximately zero, also called a "null," at approximately 90 degrees and 270 degrees. The view of FIG. 2 shows that antennas are "directional", meaning that power is greater in one direction compared to others. The illustration in FIG. 2 shows that a person directly in front of (at 0 degrees) the antenna 100 will receive maximum radiation power, while a person directly above (at 90 degrees) will receive little or no signal.

Figure 3:
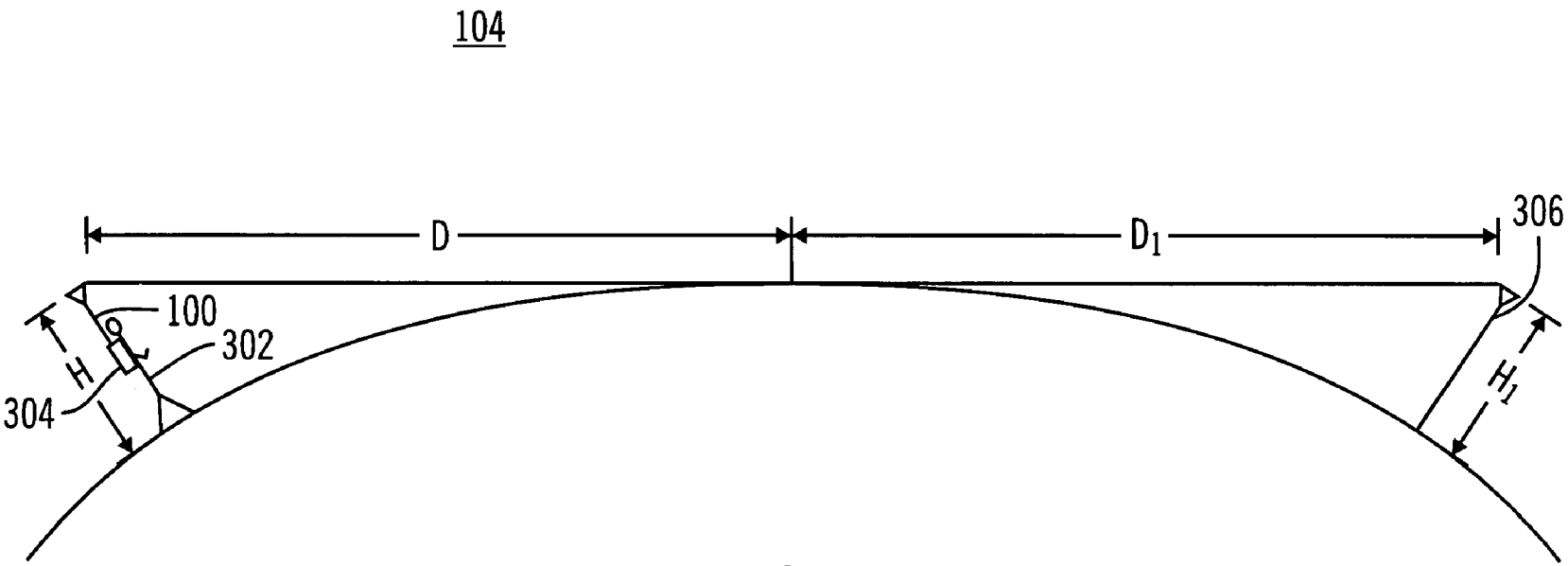
FIG. 3 is a diagram illustrating a communication range of the inventive antenna.

FIGS. 2 and 3 illustrates why the transmission from the present invention is referred to as "line-of-sight". Referring now to FIG. 3, a person 302 is shown wearing a "Man Pack", which includes a backpack 304 including a radio (not shown) and the present inventive antenna 100. The Man Pack configuration makes communication possible regardless of whether the wearer is on the move or at halt. It should be noted that the inventive antenna is wearable on more than just a person, and can be attached to vehicles and other moving objects, as well as stationary platforms.

The electromagnetic waves 102*a–n* (not shown) are propagating through a medium 104, which is usually air. The medium 104 can affect the propagation distance, speed, and uniformity. In free space, the field intensity of the wave decreases directly with the distance from the source of the wave. For instance, if the signal strength 1000 meters from the source is 100 microvolts per meter, the field strength 2000 meters from the source will be 50 microvolts per meter. The decrease in power is due to, as shown in FIGS. 1 and 2, the fact that the energy in each wave is spread over larger and larger spheres as the distance from the source increases. Since the earth is spherical and electromagnetic waves produced by an antenna do not penetrate the earth's surface to any considerable extent, the above-mentioned natural decrease in power is greatly increased if the transmitting and receiving antennas are not within a line-of-sight from one another.

The distance of true line-of-sight communication, however, is greater than the distance of optical line-of-sight. This is due to the fact that the structure of the atmosphere near the earth's surface is such that under normal conditions, the waves are bent into a curved path that keeps them nearer to the earth than true straight-line travel. The equation for calculating the distance from the transmitting antenna to the horizon is:

$$D(\text{miles})=1.41\times\text{sqrt}(H(\text{feet}))$$

Where H is the height of the transmitting antenna, as shown in FIG. 3. The equation assumes that the earth's surface is free of obstructions out to the horizon. Any obstructions will decrease the distance and must be taken into consideration.

If the receiving antenna 306 is also elevated to a height H1, the maximum line-of-sight distance between the two antennas is equal to D+D1, which is the sum of the distance to the horizon from the transmitting antenna and the distance to the horizon from the receiving antenna. For example, two man pack radios with an antenna height of 6 feet, can be separated approximately 7 miles for line-of-sight communication, provided no obstacles are between them.

The "bandwidth" of an antenna is defined as "the range of frequencies within which the performance of the antenna, with respect to some characteristic, conforms to a specific standard." The bandwidth is usually considered to be the range of frequencies on either side of a center frequency (usually the resonant frequency), where the antenna characteristics are within an acceptable value to those at the center frequency. Characteristics of interest include gain, input impedance, radiation efficiency, and beamwidth. The present invention increases bandwidth by placing two or more elements in an arrangement called an "array."

Figure 4:
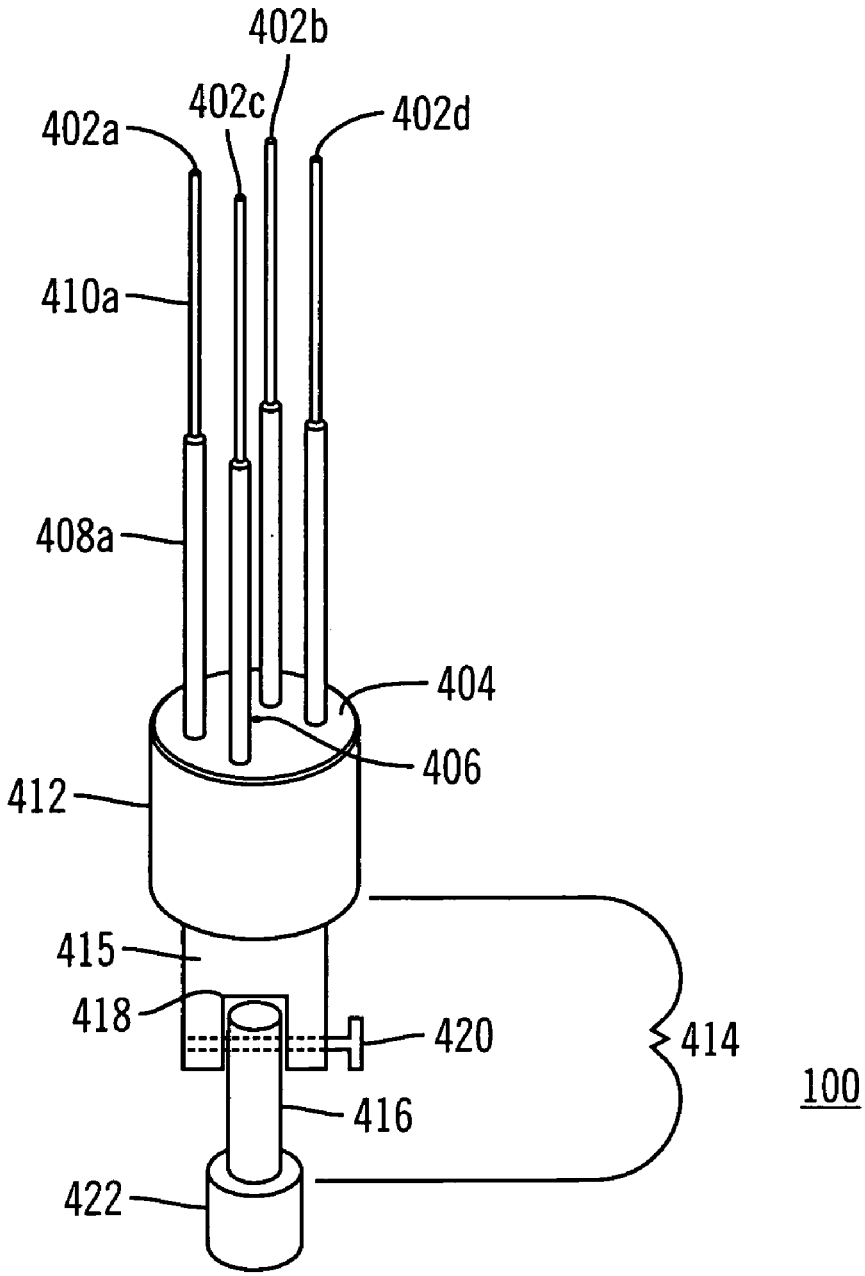
FIG. 4 is a isometric view of the inventive antenna.

Referring now to FIG. 4, the antenna assembly 100 of the present invention is shown, which includes four telescoping antenna elements 402*a–d* arranged in a circular array on a mounting plate 404. In the preferred embodiment, the plate 404 is circular conductive disk and the elements 402*a–d* are arranged concentric with the circular disk 404. It should be noted that the number of elements can vary from the number shown in FIG. 4 depending on the particular application and that the number 4 is chosen for exemplary purposes only and that the invention is not so limited. Depending on the intended use and factors such as power, efficiency, bandwidth, size, and others, any number of radiation elements 402*a–n* can be provided.

Point 406 on the mounting disk 404 marks the center of the disk 404. In one embodiment, each element of the array 402*a–d* is equally spaced away from each other element and from point 406 and the disc 404 connects all the telescoping antenna elements 402*a–d* and serves as the antenna feed point or excitation terminal. However, in other embodiments, the positions of the elements 402*a–d* can be varied with respect to distance from each other and from the center point 406.

In one embodiment, point 406 is the feed point for the disk 404, which is the point where a feed wire (not shown) is electrically connected to the disk 404. In this way, all of the equidistant elements 402*a–d* are simultaneously electrically excited by a signal input onto the disk by the feed wire. It has been realized that simultaneously feeding an electrical signal to multiple elements in a circular array causes the overall antenna to behave and appear electrically as one element that is much larger in dimension than any of the individual elements, which provides greater electrical performance over a larger bandwidth.

It is to be noted that feeding the disk 404 at the center 406 is not required and other areas on the disk 404 will work equally as well. In fact, due to differences in materials and workmanship, feeding the disk 404 at points other than center point 406 may provide even more improved performance.

As can be seen in FIG. 4, the elements 402*a–d* are vertically oriented and parallel with each other. The top ends of elements 402*a–d* are open and not connected together. In other embodiments, the elements 402*a–d* are connected together, placing two or more of the elements in electrical communication with one another. Each element 402*a–d* includes at least two sections, for example, 408*a* and 410*a*, in electrical communication, which combine to create a telescoping, i.e., length altering, element. In a preferred embodiment, the element sections are tubular and concentric within each other, similar to a common automobile antenna. As is well known in the art of communications, radiation efficiency is dependent on antenna length at any given frequency. Elements 402*a–d* are telescoping so that the length of each element can be easily adjusted to reach maximum radiation efficiency. The elements, when at their minimum length, are also compact and easily transportable.

FIG. 4 shows each element 402*a–d* having a first section 408*a–d* and a second section 410*a–d*, respectively. The sections are concentric tubular metallic sections that make constant electrical contact while any section slides into any other section. Because the sections are concentric and slide into the each other, the overall length of the antenna element can be adjusted and radiation continues to occur at any length between the limits of the element. Any number of sections can be utilized and other methods of telescoping or adjusting the length of an antenna may be used and are within the spirit and scope of the present invention.

The circular mounding disk 404 is attached to a body section 412, which houses electrical matching circuitry (not shown) for matching the impedance of the elements 402*a–d*, including the mounting disk 404, to that of the circuit feeding the signal, i.e., the radio. The matching circuit includes inductive and capacitive elements. Impedance matching is well known in the art; therefore, impedance matching and particulars of such circuits will not be further described. In one embodiment, the body section 412 is constructed of a composite material to electrically isolate the disk 404 from a metallic conductive swivel assembly 414 attached at an opposite side of the body section 412.

The swivel assembly 414 includes two sections: a channel section 415 and a post 416. Channel section 415 defines a channel 418. The post 416 fits within the channel 418 and is held in place with a fastening means, such as a pin 420 (or bolt, Velcro, rivet, or other suitable attachment.) In one embodiment, one side of the channel 418 is provided with threads. When the pin 420 is tightened, the width of the channel 418 is reduced and pressure is exerted on the post 416 within the channel 418, thereby locking the post 416 and channel 418 into a fixed position. When the pin 420 is not tightened, pitch of the antenna elements 402*a–d*, mounting disk 404, and body 412 is adjusted by rotating the channel 418 in relation to the post 416, which remains in a fixed position. In this way, the total variation in pitch of the antenna elements is adjusted as much as 180 degrees. Referring back to the illustration in FIG. 2, it can be seen that antenna performance varies with angle. Therefore, it is important to provide an ability to change the pitch of the elements with the swivel assembly. It should be noted that other methods of varying the angle of the elements have been contemplated and can be used without departing from the true scope and spirit of the present invention.

Figure 5:
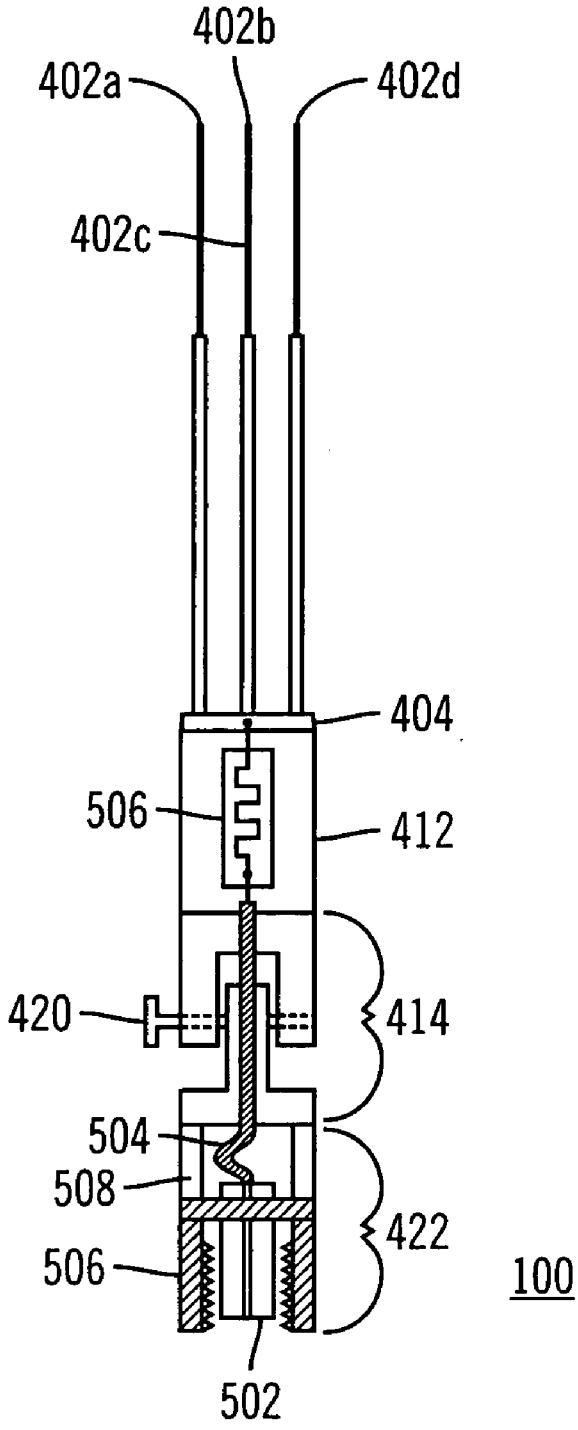
FIG. 5 is a side cutaway view of FIG. 4, in accordance with the inventive antenna.

Also attached to antenna 100 is a connector assembly 422 that houses a connector that electrically connects the antenna 100 to a radio (not shown) and serves as an antenna-radio interface. The connector 502, which is shown in FIG. 5, is preferably one commonly used in the communications field, such as a BNC or CNC connector. The connector assembly 422 electrically couples, and in one embodiment is rigidly attached to the swivel assembly 414 so that when the connector 502 is properly connected to the output of the radio, the entire antenna assembly 100 is rigidly attached to the radio and the radio and antenna assembly 100 then move as a single unit. However, the connector assembly 422 includes two sections: 506, which is shown in cross-hatching, and 508, which includes the rest of the connector assembly, including the connector 502. The two sections 506 and 508 are able to rotate relative to one another, up to 180 degrees of rotation, allowing the antenna 100 to provide rotation for an azimuth adjustment.

A coaxial cable 504 runs from the connector 502, through the swivel assembly 414, and into the body section 412. It is through the cable 504 that the signal is transferred from the radio to the matching circuitry 506 within the body section 412, and finally to the disk 404 that feeds the elements 402*a–d*. The coaxial cable 504 is flexible and easily bends when the swivel assembly is being positioned.

Figure 6:
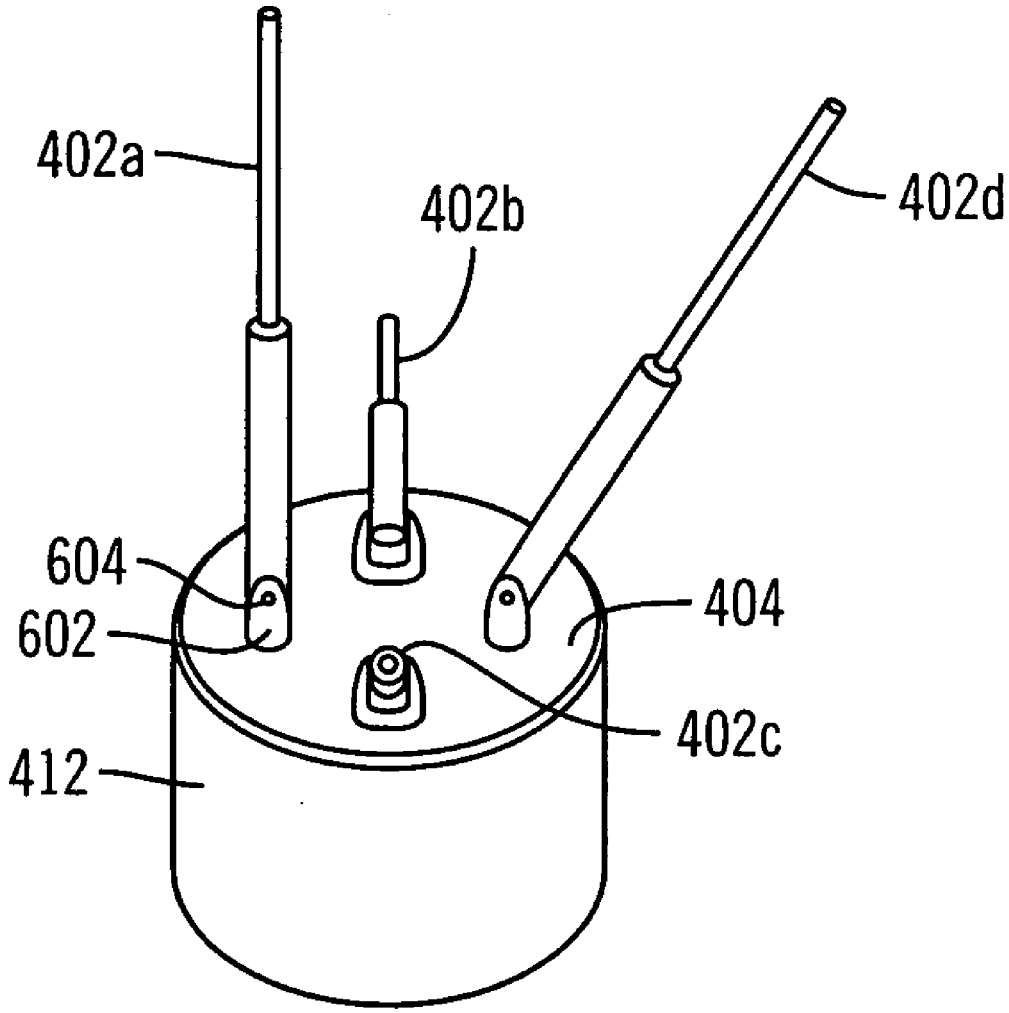
FIG. 6 is a diagram illustrating an embodiment of the elements of FIG. 5, in accordance with the inventive antenna.

Referring now to FIG. 6, an embodiment of the present invention is shown, where the elements 402*a–d* are provided with a bendable section, defined as a joint along the length of the element, preferably as close to the disk 404 as possible. In a preferred embodiment, the joint includes a section 602 connected to the disk 404 at one end and connected to the element at a second end with a pin 604 that provides a point of rotation for the element while maintaining electrical conductivity between the section 602, disk 404, and each element 402*a–d*. The joints 602, 604 enable the telescoping radiators to be arranged in a vertical position as depicted in FIG. 1 or in a conical arrangement with the vertex or apex at the mounting disc. The angle of the conical radiators can be set to provide optimum antenna bandwidth and directionality. It is contemplated that the bendable section can be one of several other ways to move and secure the elements in an orientation other than vertical and the joint just described is only for exemplary purposes.

When used in the field, the inventive antenna 100 is compact and lightweight, so as to be easily carried by military personnel over long distances. The telescoping feature of the antenna elements provides an antenna that is stowable when not in use and easily and quickly deployable. The antenna is adjustable in individual element length, individual element angle, and complete array angle to provide maximum bandwidth and efficiency and optimum directionality and directivity.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A wearable array antenna comprising:

an antenna-radio interface;

a conductive plate in electrical communication with the antenna-radio interface at an antenna side of the antenna-radio interface; and a plurality of telescoping omnidirectional radiating elements in electrical communication with the plate, arranged substantially equidistant from a point on the plate, and electrically fed from the point on the plate so as to radiate and receive with substantially equal amplitude and phase.

2. The antenna according to claim 1, wherein the plurality of telescoping omnidirectional radiating elements are arranged in a circular array.

3. The antenna according to claim 1, wherein the plurality of telescoping omnidirectional radiating elements are equidistant from each other.

4. The antenna according to claim 1, wherein the antenna-radio interface rigidly attaches the antenna to a radio so that the antenna and radio move together as a single unit.

5. The antenna according to claim 1, wherein at least one of the telescoping omnidirectional radiating elements includes:

a bendable section to provide an angular adjustment relative to the conductive plate.

6. The antenna according to claim 1, further comprising:

a body section that includes at least one impedance matching circuit arranged between the radio-antenna interface and the conductive plate.

7. The body section according to claim 6, further comprising a signal amplifying circuit.

8. The antenna according to claim 1, further comprising the antenna-radio interface being a coaxial cable connector.

9. The antenna according to claim 1, wherein each of the plurality of telescoping omnidirectional radiating elements further comprises:

at least two concentric tubular sections.

10. In a portable communication system having a portable power source and a portable radio, the system comprising:

an antenna attached to the radio, the antenna including:

an antenna-radio interface;

a conductive plate in electrical communication with the antenna-radio interface at an antenna side of the antenna-radio interface; and a plurality of telescoping omnidirectional radiating elements in electrical communication with the plate, arranged substantially equidistant from a point on the plate, and electrically fed from the point on the plate so as to radiate and receive with substantially equal amplitude and phase.

11. The system according to claim 10, wherein the plurality of telescoping omnidirectional radiating elements are arranged in a circular array.

12. The system according to claim 10, wherein the plurality of telescoping omnidirectional radiating elements are arranged equidistant from each other.

13. The system according to claim 10, wherein the antenna-radio interface rigidly attaches the antenna to a radio so that the antenna and radio move together as a single unit.

14. The system according to claim 10, wherein at least one of the telescoping omnidirectional radiating elements includes:

a bendable section to provide an angular adjustment relative to the conductive plate.

15. The system according to claim 10, further comprising:

a body section that includes at least one impedance matching circuit arranged between the radio-antenna interface and the conductive plate.

16. The body section according to claim 15, further comprising a signal amplifying circuit.

17. The system according to claim 10, further comprising the antenna-radio interface being a coaxial cable connector.

18. The system according to claim 10, wherein each of the plurality of telescoping omnidirectional radiating elements further comprises:

at least two concentric tubular sections.

* * * * *

UNITED STATES PATENT AND TRADEMARK OFFICE

CERTIFICATE OF CORRECTION

PATENT NO. : 7,102,590 B2
APPLICATION NO. : 10/941141
DATED : September 5, 2006
INVENTOR(S) : Florenio Pinili Regala It is certified that error appears in the above-identified patent and that said Letters Patent is hereby corrected as shown below:

On Title Page
Item 73
Assignee: "FPR Enterprises, LLC," to -- Florenio Pinili Regala, an individual, --

Signed and Sealed this

Eleventh Day of December, 2007

JON W. DUDAS
*Director of the United States Patent and Trademark Office*